US008648748B2

(12) United States Patent
Yakubovich et al.

(10) Patent No.: US 8,648,748 B2
(45) Date of Patent: Feb. 11, 2014

(54) EFFECTIVE MARINE STABILIZED ANTENNA SYSTEM

(75) Inventors: Azriel Yakubovich, Kfar Yona (IL); Guy Naym, Netanya (IL); Idan Fogel, Netanya (IL); Ervin Rozman, Netanya (IL); Shlomo Levi, Shoham (IL); Michael Greenspan, Givat Haim Meuhad (IL); Moshe Gvili, Ganot Hadar (IL); Or Dadush, Tel Aviv (IL); Benny Ben Rey, Even Yehuda (IL)

(73) Assignee: Orbit Communication Ltd., Netanya (IL)

( * ) Notice: Subject to any disclaimer, the term of this patent is extended or adjusted under 35 U.S.C. 154(b) by 395 days.

(21) Appl. No.: 13/026,255

(22) Filed: Feb. 13, 2011

(65) Prior Publication Data

US 2011/0304496 A1 Dec. 15, 2011

Related U.S. Application Data

(60) Provisional application No. 61/354,277, filed on Jun. 14, 2010.

(51) Int. Cl.

| | |
|---|---|
| ***H01Q 19/18*** | (2006.01) |
| ***H01Q 3/08*** | (2006.01) |
| ***H01Q 19/19*** | (2006.01) |

(52) U.S. Cl.

CPC ..... *H01Q 19/192* (2013.01); *H01Q 3/08* (2013.01)

USPC ..... 342/359; 343/781 CA

(58) Field of Classification Search

CPC ..... H01Q 19/192

USPC ..... 342/359; 343/709, 757

See application file for complete search history.

(56) References Cited

U.S. PATENT DOCUMENTS

| | | | | |
|---|---|---|---|---|
| 3,893,123 | A * | 7/1975 | Bieser | 343/706 |
| 5,419,521 | A | 5/1995 | Matthews | |
| 5,922,039 | A * | 7/1999 | Welch et al. | 701/116 |
| 6,043,788 | A * | 3/2000 | Seavey | 343/781 CA |
| 6,774,861 | B2 * | 8/2004 | Choung et al. | 343/781 CA |

(Continued)

FOREIGN PATENT DOCUMENTS

| | | |
|---|---|---|
| EP | 1986016 | 10/2008 |

OTHER PUBLICATIONS

Westcott, B.S. et al. "Synthesis of Dual-Offset Spaed Reflectors for Arbitrary Aperture Shapes Using Continuous Domain Deformation," IEEE Proc. Microwaves, Antennas and Propagation. Feb. 1986. vol. 133, Issue 1. pp. 57-64.*

(Continued)

*Primary Examiner* — Gregory C Issing

(74) *Attorney, Agent, or Firm* — Mark M. Friedman

(57) ABSTRACT

An effective marine stabilized antenna system, in terms of antenna to radome size and antenna/RF performance complies with all relevant worldwide SatCom regulations. The combination of a dual offset Gregorian antenna (DOGA) with a stabilized polarization over elevation over tilt over azimuth pedestal, and a control/stabilization algorithm, ensures antenna orientation restrictions guarantee compliance with side-lobe intensity regulations. Operating a dual offset Gregorian antenna substantially within a pre-determined antenna cut range of a 45 degree angle relative to a configuration of the antenna and a relative position of a target provides antenna performance that complies with applicable SatCom regulations, despite having to flip the antenna 90 degrees to continue tracking the satellite.

29 Claims, 9 Drawing Sheets

(56) References Cited

U.S. PATENT DOCUMENTS

| | | | | |
|---|---|---|---|---|
| 7,009,558 | B1 * | 3/2006 | Fall et al. | 342/359 |
| 7,450,079 | B1 * | 11/2008 | Baldauf et al. | 343/781 CA |
| 7,911,403 | B2 * | 3/2011 | Berejik | 343/761 |
| 2006/0132371 | A1 * | 6/2006 | Jeon et al. | 343/757 |

OTHER PUBLICATIONS

OrSat AL-7103 MKII 1.15m (45) Ku Band Marine Stabilized Tx/Rx Brochure. 2008. pp. 1-2.*

Orbit Technology Group, AL-7103-C-C & AL-7103-C-L 1.28m C-Band (Circularo or Linear) Marine Stabilized Tx/Rx System Brochure. 2008. pp. 1-2.*

Terada, M. "Dual Offset Multibeam Antennas for Satellite Applications." Journal of Microwaves and Optoelectronics, vol. 3, No. 2, Aug. 2003. pp. 40-45.*

"Ornat AL-7103 MKIL—Factsheet" 2007 , Retrieved from the Internet: URL:http://Orsat- Degital.pdf.

Guy Nayum, Orbit Technology :"Satellite Regulations and type approvals for mobile satcom systems", Oct. 2008, pp. 1-9.

* cited by examiner

TYPICAL WORLDWIDE SATCOM (SATELLITE COMMUNICATIONS) REGULATIONS

| ITU S.465 & Intelsat IESS C-band Co-Pol Sidelobes | | | |
|---|---|---|---|
| 32 – 25Log(Θ) | dBi | for | 100λ/D ° ≤ Θ ≤ 48 ° |
| −10 | dBi | for | 48 ° < Θ ≤ 180 ° |
| D/λ = 35 (< 50) and 100λ/D = 2.8 ° | | | |

| ITU S.524 & Intelsat C-band Antenna EIRP/BW | | | |
|---|---|---|---|
| 42 – 25Log(Θ) | dBW/40kHz | for | 2.5 ° ≤ Θ ≤ 7.0 ° |
| 21 | dBW/40kHz | for | 7.0 ° < Θ ≤ 9.2 ° |
| 45 – 25Log(Θ) | dBW/40kHz | for | 9.2 ° < Θ ≤ 48 ° |
| 3 | dBW/40kHz | for | 48 ° < Θ ≤ 180 ° |

| EESS-502 C-band Antenna Sidelobes * | | | |
|---|---|---|---|
| 29 – 25Log(Θ) | dBi | for | α ° ≤ Θ ≤ 7.0 ° |
| 8 | dBi | for | 7.0 ° < Θ ≤ 9.2 ° |
| 32 – 25Log(Θ) | dBi | for | 9.2 ° < Θ ≤ 48 ° |
| −10 | dBi | for | 48 ° < Θ ≤ 180 ° |

| EESS-502 C-band Antenna EIRP/BW * | | | |
|---|---|---|---|
| 42 – 25Log(Θ) | dBW/40kHz | for | α ° ≤ Θ ≤ 7.0 ° |
| 21 | dBW/40kHz | for | 7.0 ° < Θ ≤ 9.2 ° |
| 45 – 25Log(Θ) | dBW/40kHz | for | 9.2 ° < Θ ≤ 48 ° |
| 3 | dBW/40kHz | for | 48 ° < Θ ≤ 180 ° |

| Anatel #364 C-band Antenna Sidelobes | | | |
|---|---|---|---|
| 29 – 25Log(Θ) | dBi | for | 100λ/D ° ≤ Θ ≤ 20 ° |
| -3.5 | dBi | for | 20 ° < Θ ≤ 26.3 ° |
| 32 – 25Log(Θ) | dBi | for | 26.3 ° < Θ ≤ 48 ° |
| −10 | dBi | for | 48 ° < Θ ≤ 180 ° |

| Anatel #902 C-band Antenna EIRP/BW | | | |
|---|---|---|---|
| 42 – 25Log(Θ) | dBW/40kHz | for | 2.5 ° ≤ Θ ≤ 7.0 ° |
| 21 | dBW/40kHz | for | 7.0 ° < Θ ≤ 9.2 ° |
| 45 – 25Log(Θ) | dBW/40kHz | for | 9.2 ° < Θ ≤ 48 ° |
| 3 | dBW/40kHz | for | 48 ° < Θ ≤ 180 ° |

| FCC 25.209 C-band Antenna Sidelobes | | | |
|---|---|---|---|
| 29 – 25Log(Θ) | dBi | for | 1.5 ° ≤ Θ ≤ 7.0 ° |
| 8 | dBi | for | 7.0 ° < Θ ≤ 9.2 ° |
| 32 – 25Log(Θ) | dBi | for | 9.2 ° < Θ ≤ 48 ° |
| −10 | dBi | for | 48 ° < Θ ≤ 180 ° |

| FCC 25.221 C-band Antenna EIRP/BW ** | | | |
|---|---|---|---|
| 36.3 – 25Log(Θ) | dBW/40kHz | for | 1.5 ° ≤ Θ ≤ 7.0 ° |
| 15.3 | dBW/40kHz | for | 7.0 ° < Θ ≤ 9.2 ° |
| 39.3 – 25Log(Θ) | dBW/40kHz | for | 9.2 ° < Θ ≤ 48 ° |
| −2.7 | dBW/40kHz | for | 48 ° < Θ ≤ 180 ° |

* α = 100λ/D, where D is the antenna diameter and λ is the carrier wavelength. This formula is valid as long as 1 ≤ α ≤ 2. If the formula yields values outside this range of validity, α is set to either 1° or 2°, depending on which is nearest.

** For Θ greater than 7.0°, the envelope may be exceeded by no more than 10% of the sidelobes, provided no individual sidelobe exceeds the envelope given above by more than 3 dB.

FIGURE 4

EFFECTIVE MARINE STABILIZED ANTENNA SYSTEM

FIELD OF THE INVENTION

The present embodiment generally relates to antennas, and in particular, it concerns transmitting and receiving signals from a mobile platform.

BACKGROUND OF THE INVENTION

Satellite communications have made communications accessible and available at any point in time from any point on Earth. Whether at sea, in the air, or on land, customers demand continuous broadband connectivity for a variety of communications including telephony, internet, and television, as well as monitoring, command, and control. Applications demand various bandwidths and frequencies, as well as real-time, accurate, and quality communications.

Referring to FIG. 12, a diagram of geostationary satellites showing transmission interference, as the demand for communication increases, and more and more satellites are being placed in geostationary orbit 1200 around the Earth 1210. As geostationary satellites are being positioned closer and closer to each other, the geostationary orbit, or arc of geostationary satellites, has become more "crowded in space". This physical proximity between adjacent satellites, currently standing at typical values of around 2 degrees, requires transmitting Earth stations 1212 to limit the Earth station's effective incident radiated power (EIRP) per bandwidth toward the adjacent satellites. A plot of antenna radiation patterns 1202 shows mainlobe transmission to a target satellite 1204 and sidelobes with can interfere with other satellites, such as satellites in adjacent orbit (1206A, 1206B). Further information can be found in the paper *Satellite Regulations and Type Approvals for Mobile Satcom Systems* by Guy Naym, published in Worldwide Satellite Magazine, October 2008.

Current antenna solutions trade-off system size, weight, cost, capability, and in particular antenna size and radome size, to provide a given level of performance to users. The performance of antenna systems effects many areas, in particular the legal requirements to meet international specifications and the operating costs for users. Operating costs include the costs for providing the desired service, as well as additional and penalty costs when antenna systems do not meet the satellite regulations transmission specifications (to avoid interference to adjacent satellites) for the area in which the antenna system is operating.

There is therefore a need for a method and system for transmitting and receiving communication signals with a reduced sized antenna system while meeting the required satellite communications regulations.

SUMMARY

According to the teachings of the present embodiment there is provided a system for aiming a dual offset noncircular antenna system (DONCA) from a mobile platform to a target, the system including: a pedestal system mounted to the mobile platform and operational to control orientation of the DONCA; a motion sensing system operational to provide motion information on the orientation of the DONCA relative to the mobile platform; and a control system operationally connected to the motion sensing system and configured to use the motion information to control the pedestal system to maintain an inclination of the DONCA substantially within a pre-determined antenna inclination range of a 45 degree angle relative to a configuration of the DONCA and a position of the target.

In an optional embodiment, the dual offset noncircular antenna system (DONCA) is a dual offset Gregorian antenna system (DOGA). In another optional embodiment, the dual offset noncircular antenna system (DONCA) is a dual offset Cassegrain antenna system.

In another optional embodiment, the mobile platform is a ship. In another optional embodiment, the pedestal system is a 4-axis pedestal system operational to control the DONCA. In another optional embodiment, the target is a geostationary satellite.

In an optional embodiment, the motion sensing system includes an inertial measurement unit (IMU). In another optional embodiment, the IMU is mounted to the mobile platform. In another optional embodiment, the motion sensing system includes axes sensors on the pedestal system.

In an optional embodiment, the 45 degree angle is relative to a reference line from a feed mounted on a surface of the DONCA to an edge of the DONCA of the surface and opposite the feed. In another optional embodiment, the pre-determined antenna inclination range includes angles substantially between 30 and 60 degrees. In another optional embodiment, the DONCA is maintained such that sidelobes of a radio frequency (RF) signal transmitted from the DONCA are suppressed below a pre-determined level. In another optional embodiment, the inclination of the DONCA is maintained at an oblique angle relative to a feed of the DONCA sufficient to suppress below a pre-determined level sidelobes of a radio frequency (RF) signal transmitted from the DONCA.

In an optional embodiment, the system further includes a radome, the DONCA, and the pedestal system being mounted inside the radome. In another optional embodiment, a ratio of an outside diameter of the radome to a long axis of the DONCA is less than 1.24.

In an optional embodiment, the DONCA operates at C-hand frequencies including receiving at 3.4-4.2 GHz and transmitting at 5.8-6.7 GHz. In another optional embodiment, the DONCA operates at Ku-band frequencies including receiving at 10.7-12.7 GHz and transmitting at 13.7-14.5 GHz. In another optional embodiment, the DONCA operates at X-band frequencies including receiving at 7.2-7.7 GHz and transmitting at 7.9-8.4 GHz. In another optional embodiment, the DONCA operates at Ka-band frequencies including receiving at 17.7-21.2 GHz and transmitting at 27.5-31 GHz.

According to the teachings of the present embodiment there is provided a method including the steps of: measuring an orientation of a dual offset noncircular antenna system (DONCA) relative to a mobile platform whereon the DONCA is mounted; aiming the DONCA at a target while, responsive to the measuring of the orientation, maintaining an inclination of the DONCA substantially within a pre-determined antenna inclination range of a 45 degree angle relative to a configuration of the DONCA and a position of the target.

In an optional embodiment, the aiming of the DONCA is via a 4-axis pedestal system.

In an optional embodiment, the measuring of the orientation includes measuring via a motion sensing system that includes an inertial measurement unit (IMU).

In an optional embodiment, the measuring of the orientation includes measuring via axes sensors on a pedestal system, wherein the pedestal system is used to aim the DONCA.

In an optional embodiment, a plurality of radio frequencies (RFs) is associated with the target and the aiming is based on one of the plurality of RFs.

In an optional embodiment, the aiming is based on information derived from a signal strength of a radio frequency (RF) associated with the target.

BRIEF DESCRIPTION OF FIGURES

The embodiment is herein described, by way of example only, with reference to the accompanying drawings. Unless otherwise noted, in the drawings antenna plots include a logarithmic vertical axis of power in dBi and a horizontal axis in degrees of azimuth.

FIG. 4, a chart with typical worldwide SatCom (satellite communications) regulations.

DETAILED DESCRIPTION

Figure 1:
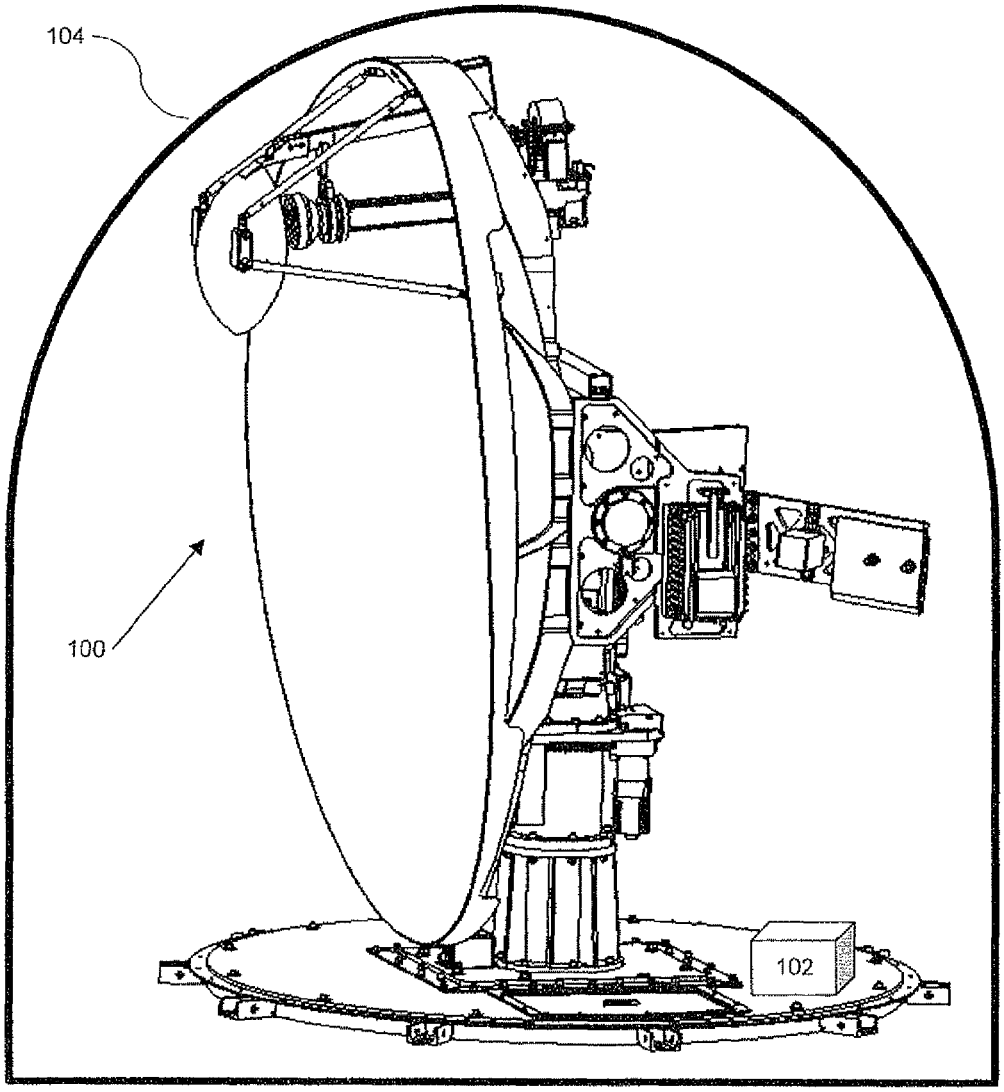
FIG. 1, a diagram of a reduced sized antenna system in a radome.

The principles and operation of the system according to a present embodiment may be better understood with reference to the drawings and the accompanying description. A present embodiment is a system for transmitting and receiving a signal from/to a mobile platform to/from a target with a reduced sized antenna system while meeting the required satellite communications regulations.

An innovative solution includes use of a dual-offset non-circular antenna (DONCA) that reduces the size required for the antenna and radome, compared to an offset feed or center feed antenna, while providing better sidelobes (reduced sidelobes) compared to a center feed antenna. An innovative control algorithm and motion sensing system control an orientation of the DONCA such that the orientation of the DONCA to the target (known as the inclination, or "cut") of the antenna is maintained substantially within a pre-determined antenna inclination range of a 45 degree angle relative to a configuration of the antenna and a position of the target.

The system facilitates implementation of an antenna system having a radome to antenna ratio of 1.23 or less. In the context of this document, a radome to antenna ratio, or simply referred to as a ratio, refers to a ratio of an outside diameter of a radome to a diameter of an associated antenna within the radome. In contrast, conventional systems typically have ratios of 1.47 or greater. A typical conventional configuration for a 2.47 meter (m) diameter antenna is to use a 3.65 m diameter radome (ratio 1.48). In contrast one implementation of the present embodiment uses a 2.2 m antenna in a 2.7 m radome (ratio 1.23), and a second implementation uses a 3.1 m antenna in a 3.8m radome (ratio 1.23).

The availability of a reduced sized antenna system can provide a customer with increased options, including reduced system size, increased data rates, and lower operating costs, while complying with the SatCom (satellite communications) regulations. System size can be a limiting factor for customer applications, and thus a crucial feature of an antenna system. For a given data rate, a relatively smaller antenna can be used, compared to conventional implementations, saving size and cost. For a given antenna size, a relatively smaller radome can be used, saving size and cost. Using an existing radome, a larger antenna can be used compared to conventional implementations, increasing data rates. Complying with the required satellite communications regulations can also result in a cost savings. In particular, meeting the required specification for sidelobes means that less transponder bandwidth is required, reducing costs. In the context of this document, complying with the required satellite communications regulations is also referred to as meeting the required specifications.

An implementation of the current embodiment has been successfully tested using a 2.20 m antenna in a 2.70 m radome. Operation includes at C-Band Linear Frequencies for transmission at 5.85-6.725 GHz and receiving at 3.4-4.2 GHz, and operation at C-Band Circular Frequencies for transmission at 5.85-6.425 GHz and receiving at 3.625-4.2 GHz, with a system G/T of 17 dB/K. The implemented system complies with worldwide SatCom regulations including: ITU S.465 & Intelsat IESS601 C-Band Co-Pol side lobes, EESS-502 C-Band antenna side lobes, ANATEL #364 C-Band antenna side lobes, FCC 25.209 C-Band antenna side lobes, and ETSI.

In the context of this document, the term antenna generally refers to the main parabolic reflector (dish) and/or the main parabolic reflector including, but not limited to, the feed, sub-reflector(s), associated support, and counter weight(s), that are mounted on a pedestal. The term antenna system generally refers to the antenna, pedestal, radome, and associated components.

3-axis pedestals are known in the art and allow control of three axes of an associated antenna, generally referred to as azimuth (left and right), elevation (up and down), and tilt, also known as cross elevation (clockwise and counter-clockwise). For reference, when referring to movement of a marine vessel, azimuth is known as yaw, elevation as pitch, and tilt as roll. In the art, azimuth is also sometimes referred to as train axis and cross elevation referred to as cross-level. In the context of this document, the term 4-axis pedestal is generally used to refer to a 3-axis pedestal plus control of a fourth-axis of polarization, which is generally controlled in the feed. Alignment of the polarization of a feed to meet the polarization of a linearly polarized target is generally accomplished by rotating the feed. A 4-axis pedestal is also known as a stabilized polarization over elevation over tilt over azimuth pedestal. As is generally known in the field, the term feed and the term RF front end are used interchangeably to refer to the portion of the antenna system (often simply referred to as the antenna) responsible for transmitting and receiving the original outgoing and incoming radio frequency (RF) signals, respectively. A feed can also be referred to as the RF chain.

In the context of this document, the term target generally refers to a receiver that an antenna is transmitting to, or conversely, a transmitter from which an antenna is receiving.

When plotting an antenna pattern, the required communications regulations for the transmission is sometimes referred to as a mask, where the mask is plotted on the same diagram with the antenna pattern, and the plots are compared to each other to determine how well the antenna's transmission meets the regulation/specification. FIG. 4 is a chart with typical worldwide SatCom (satellite communications) regulations.

An important point for customers to be aware of, when comparing antenna performance, is that often plots of antenna performance are presented that are for a "best case" performance of an antenna, or for operation within a limited range of angles. In contrast, in order to comply with SatCom regulations, an antenna must perform within the SatCom specification wider all significant cases and at all relevant angles of operation. As can be seen from the current description, the present embodiment is an antenna system that complies with the applicable SatCom regulations even under worst case operation (45 degree operation, as described below) and at all relevant angles of operation, using an innovative combination of antenna configuration, control algorithm, and motion sensing system.

For clarity in this description, the embodiment is described with reference to transmitting from the antenna. It will be obvious to one skilled in the art that features of the current embodiment described for transmission, having results such as lower sidelobes, for receiving have results such as increased gain. The current embodiment can be used for transmission, receiving, or both.

Figure 5:
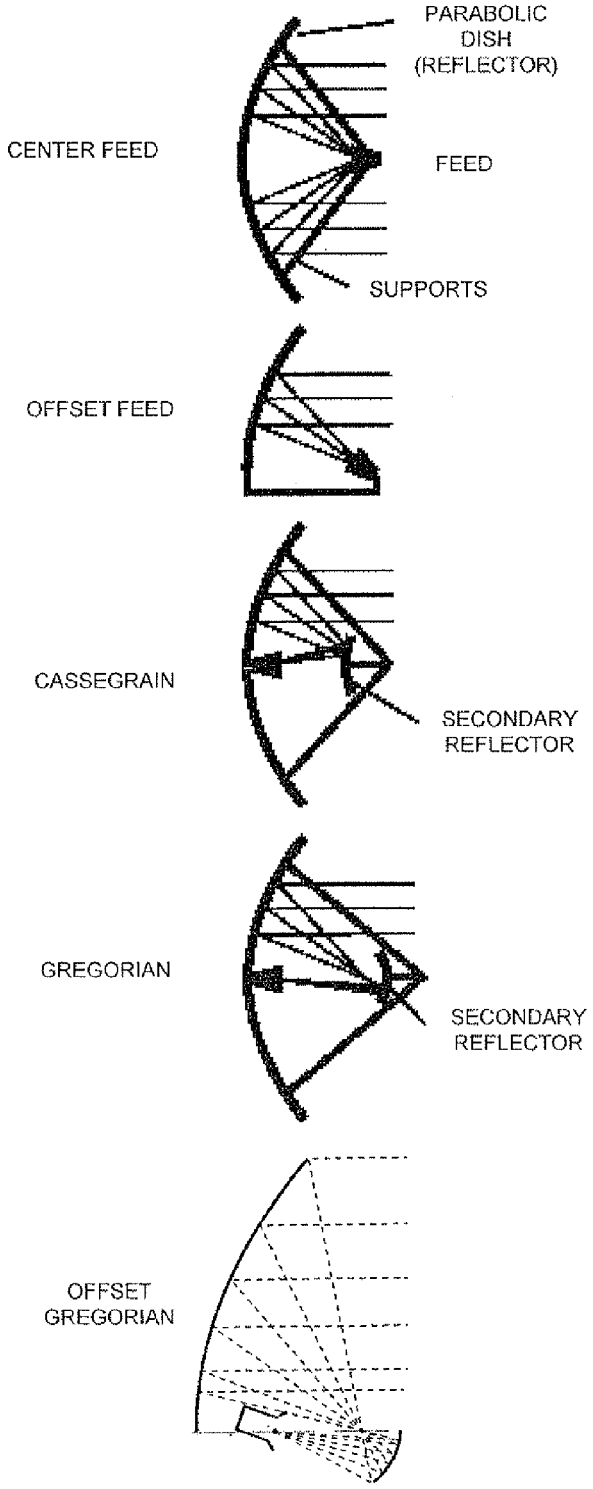
PRIOR ART FIGURE 5
FIG. 5, a diagram of conventional parabolic antennas.

Referring now to the drawings, FIG. 5 is a diagram of conventional parabolic antennas. The antennas are known as paraboloidal or dish, where the reflector is shaped like a paraboloid that radiates a narrow pencil-shaped beam along the axis of the dish. Antennas are also classified by the type of feed. Center feed is a popular antenna, with the feed located in front of the dish at the focus, on the beam axis. In an offset feed antenna, the feed is located to one side of the dish. In a Cassegrain antenna, the feed is located on or behind the dish, and radiates forward, illuminating a convex hyperboloidal secondary reflector at the focus of the dish. The radio waves from the feed reflect back off the secondary reflector to the dish, which forms the main beam. Gregorian antennas are similar to the Cassegrain design, except that the secondary reflector is concave, (ellipsoidal) in shape. Offset Gregorian antennas are similar to the Gregorian design, except the feed is located to one side of the dish. Dual-offset Gregorian antennas (DOGA) are known in the field, and include a parabolic antenna surface that is not circular, but oval or ellipse and symmetric with respect to short and long axes. The feed is not mounted in the middle of the dish, but within the circumference of the dish and toward the side of the dish. In the context of this document, the term noncircular dish or noncircular antenna generally refers to the shape of a perimeter of an antenna surface being other than circular, for example an oval or ellipse, such as the above-mentioned DOGA. The noncircular dish is symmetric around the long axis and short axis, respectively, while the lengths of the long and short axes are not equal. Refer to FIG. 1, a diagram of a reduced sized antenna system in a radome, which includes a dual-offset Gregorian antenna 100 in a radome 104.

Figure 6:
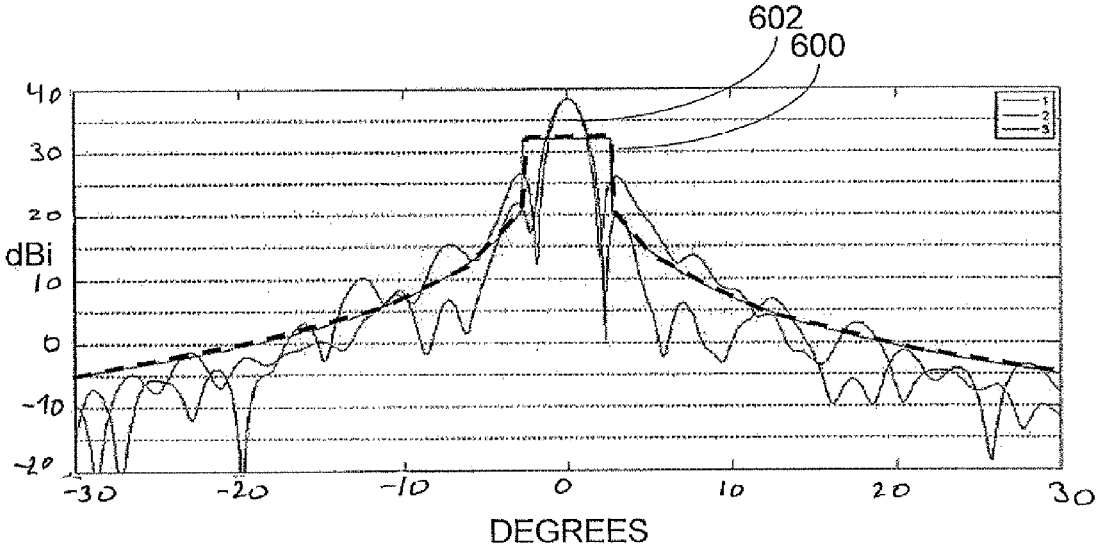
FIG. 6, a plot of an antenna pattern for a Cassegrain antenna.

Conventional systems using a center feed antenna suffer from the feed and supports for the feed blocking some of the beam, which limits the aperture efficiency and results in sidelobes. In particular, as described above, the presence of sidelobes can increase the amount of transponder bandwidth required for a communications link and/or result in noncompliance of signal transmission with the required communications regulations. Using an offset feed antenna typically provides the best performance with regard to sidelobes, as the feed structure is out of the beam path, and hence does not block the beam, but results in increased size of the antenna, as the feed is mounted outside the circumference of the antenna. Cassegrain and Gregorian antennas also suffer from obstruction of the beam path by feed and support structures, resulting in undesirable sidelobes and non-compliance with regulations. Referring to FIG. 6, a plot of an antenna pattern 602 for a Cassegrain antenna, a typical mask 600 is per ITU S.465 and Intelsat C-Band, starting at 100 $\lambda/D$. This type of antenna pattern does not comply with the SatCom Regulations.

Figure 7:
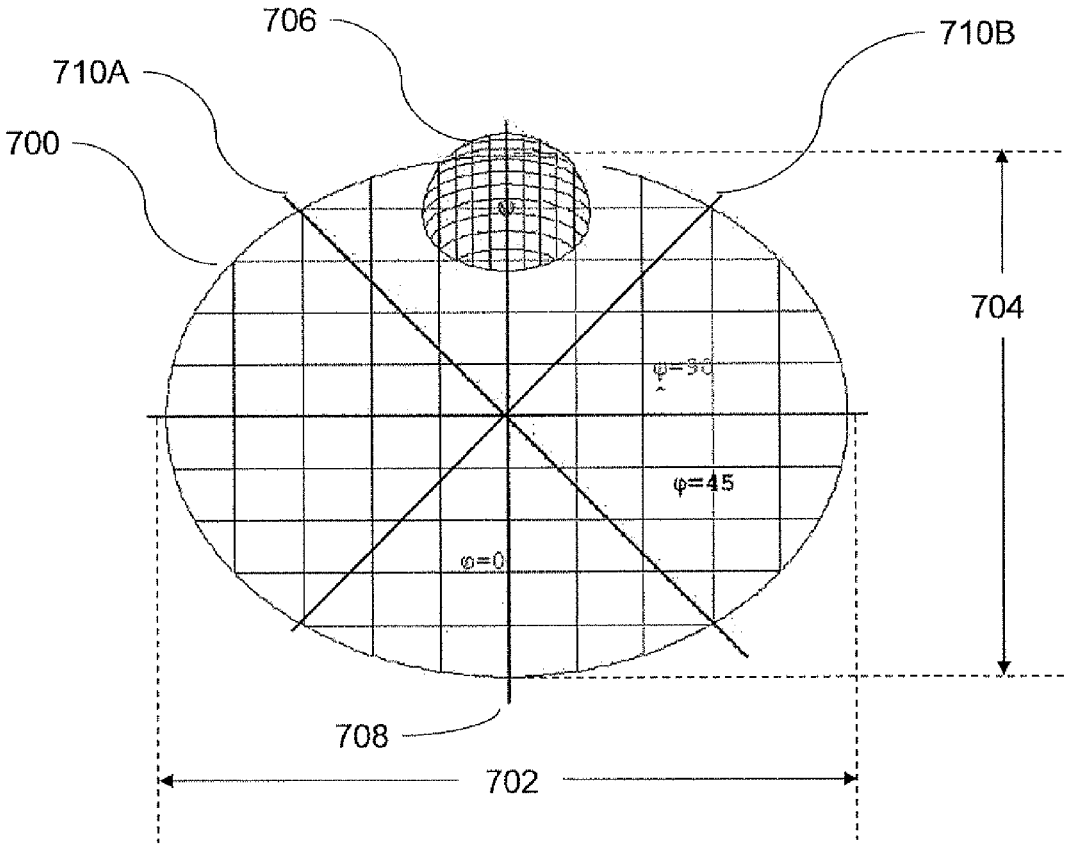
FIG. 7, a diagram of a dual offset Gregorian antenna.

Use of a dual-offset noncircular antenna reduces the size required for the antenna, compared to an offset feed antenna, while providing better sidelobes (reduced sidelobes) compared to a center feed antenna. However, another critical factor is the orientation of the antenna to the target, known as the inclination or cut. Referring to FIG. 7, a diagram of a dual offset Gregorian antenna includes an oval dish 700. As described above a DOGA is one implementation of a dual offset noncircular antenna. The oval dish has two axes, known as a long axis and a short axis, which are the long diameter 702 and short diameter 704, respectively. The feed 706 is typically mounted on the short axis. A reference line 708 from feed 706 near a first edge of dish 700, along the short axis 704 of the dish, to a second edge of dish 700 opposite feed 706 provides a convention for referring to the orientation of the dish to the target, known as the inclination. When the short axis of the dish is oriented with the target, the inclination is 0 (zero) degrees. When the long axis of the dish is oriented with the target, the inclination is 90 degrees.

A conventional approach is to try to maintain the long axis of the antenna in an optimum orientation to the target, in other words an inclination of 90 degrees, as the long axis of the antenna gives the best performance. In particular, orienting along the long axis results in the lowest level of side lobes. In a case where the target is a geostationary satellite, the conventional solution is to try to maintain the inclination of the long axis of the antenna toward the arc (geostationary orbit) of the geostationary satellite, or in other words, inclination of the long axis oriented with the arc of satellites adjacent to the target satellite in geostationary orbit. In contrast, when the short axis of the antenna is oriented with the target, the antenna gives lower performance, in particular giving the highest level of sidelobes.

The performance of conventional approaches suffers from operational realities. If an inclination of 90 degrees could be maintained, the antenna could be operated to give the best performance. However, during the course of normal operations, the orientation of the antenna needs to be flipped 90 degrees to maintain communication with the desired target, or in other words, to track the satellite. In a conventional implementation where the antenna is being operated at the optimal inclination of 90 degrees, a flip of 90 degrees results in the antenna operating at an inclination of 0 degrees (or the equivalent 180 degrees). The antenna is now operating at the lowest performance level, and in particular has the highest level of sidelobes. The antenna will continue to operate in violation of the specification/communications regulation and/or using increased bandwidth, until the antenna can be re-orientated to a different inclination with a better level of performance.

An innovative solution includes operating a dual offset non-circular antenna, for example a DOGA, substantially within a pre-determined antenna inclination range of a 45 degree angle relative to a configuration of the dual offset non-circular antenna and a position of the target, which for simplicity is referred to as operating at 45 degrees, or operating at an inclination of 45 degrees. Note that although in the context of this document reference is made to "45 degree angle" for clarity, the term "45 degree angle" should generally be interpreted as referring to an operating range around a 45 degree inclination, unless otherwise specified. When operating at 45 degrees (also referred to as operating at about 45 degrees, or an inclination of about 45 degrees), and the antenna needs to flip 90 degrees, the resulting orientation continues to operate at 45 degrees. Thus, the antenna can flip back and forth between operating relative to a positive or negative 45 degree angle of inclination. In a non-limiting example, the antenna is operating at 45 degrees as shown by line 710A, on a first side of reference line 708. After the antenna flips 90 degrees, the resulting orientation continues to operate at 45 degrees, now as shown by line 710B that is on a second side of reference line 708. An innovative control algorithm and motion sensing system control an orientation of the antenna such that an inclination of the antenna is maintained substantially within a pre-determined antenna inclination range of a 45 degree angle relative to a configuration of the antenna and a position of the target. In other words, the inclination of the antenna is maintained sufficiently far from an inclination of 0 degrees such that the performance of the antenna complies with applicable SatCom regulations, despite having to flip the antenna 90 degrees to continue tracking the satellite. An alternative description of the control algorithm is to control the orientation of the antenna such that the inclination is maintained substantially within pre-determined antenna inclination ranges that include both positive and negative 45 degree (+45 or −45 degrees) angles. Note that when an antenna is flipped 90 degrees, polarization of the feed also needs to be rotated 90 degrees to maintain polarization with a target. The current embodiment includes, but is not limited to, dual offset Gregorian and dual offset Cassegrain antennas. A preferred implementation is to use a dual offset Gregorian antenna (DOGA), which current testing has shown to achieve the best results, specifically complying with worldwide SatCom regulation with a radome to antenna ratio that is less than conventional antenna systems. It is foreseen that alternative implementations of the current embodiment, for example using a dual offset Cassegrain or other noncircular antenna dishes can be used with the method of the current embodiment. Note that although for clarity in the following description, reference is made to "DOGA", the embodiment is not limited to DOGAs and the term DOGA should be understood to include any dual offset antenna, unless otherwise specified.

Figure 8:
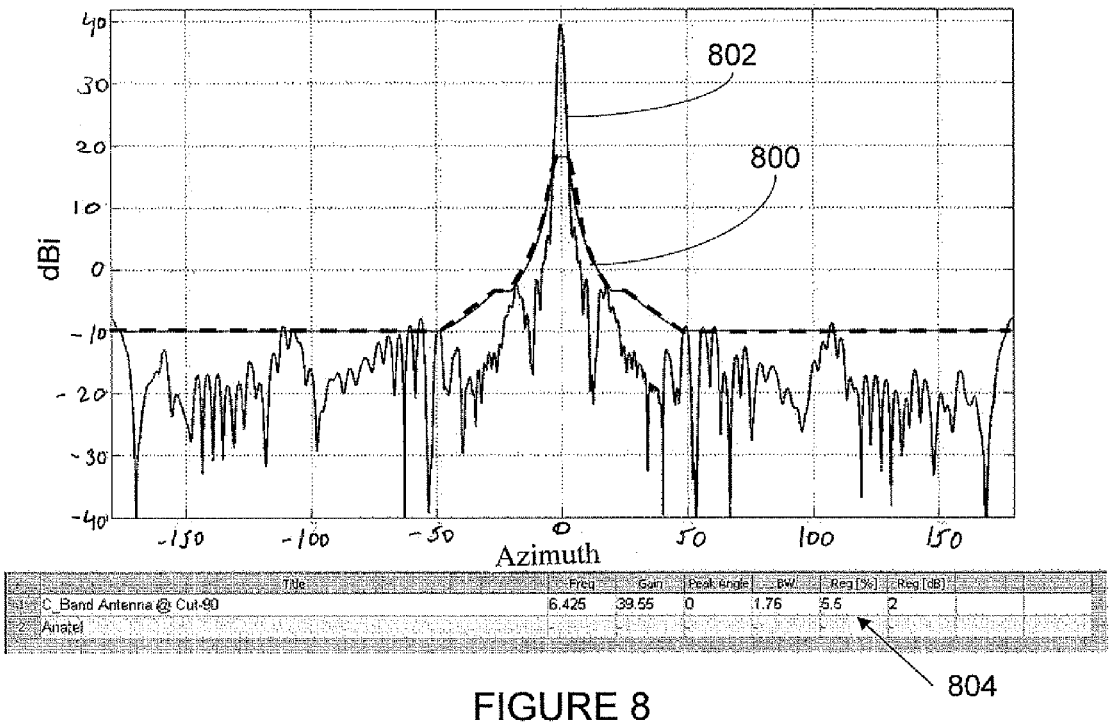
FIG. 8, a plot of an antenna pattern of a dual offset Gregorian antenna (DOGA) operating at an inclination of about 90 degrees.
Figure 9:
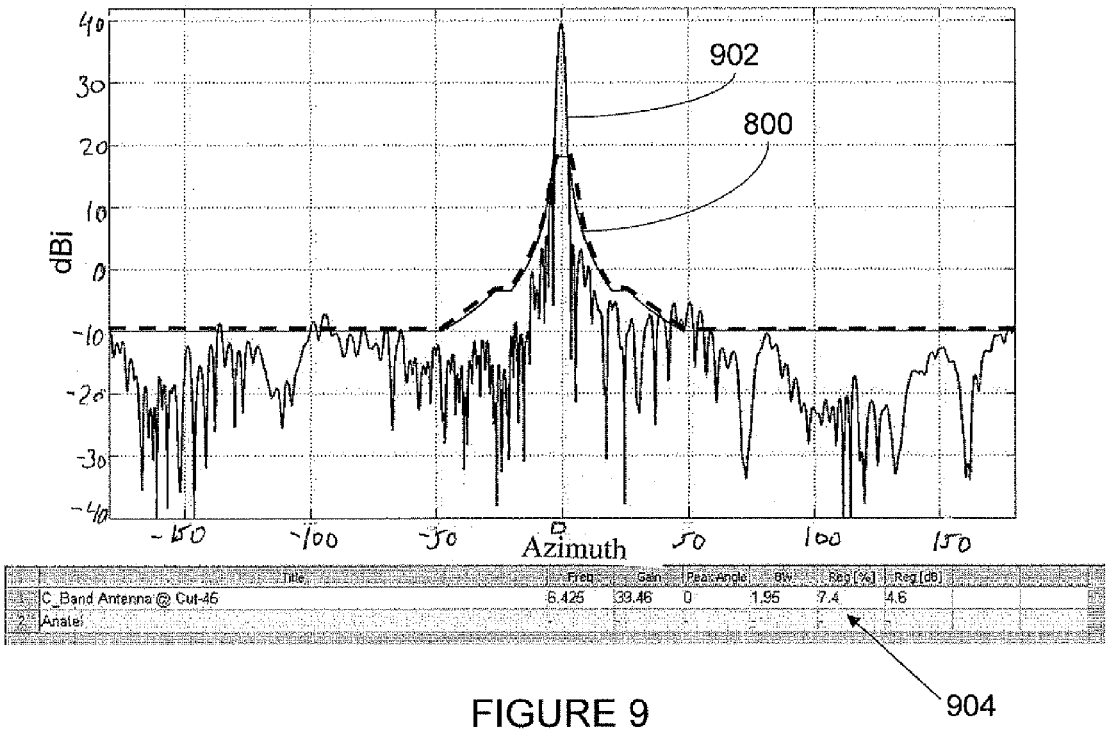
FIG. 9, a plot of an antenna pattern, from a DOGA operating according to an implementation of the current embodiment at about 45 degrees.
Figure 10:
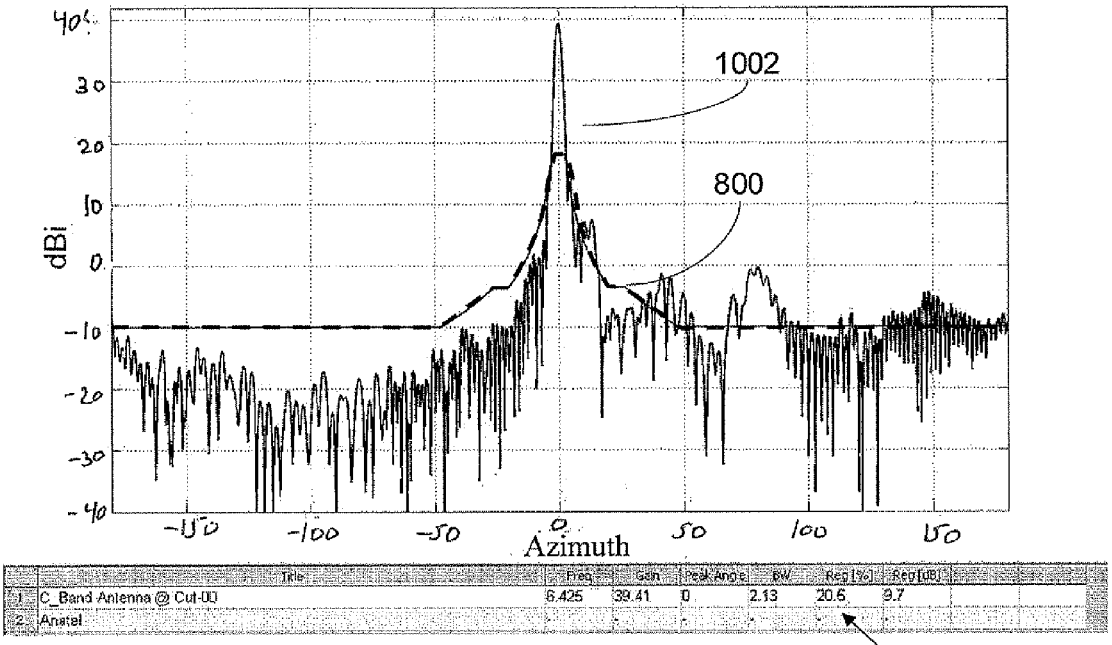
FIG. 10, a plot of an antenna pattern of a DOGA operating at an inclination of about 0 (zero) degrees.

In contrast to conventional solutions described above, operating at 45 degrees results in good performance and compliance with specifications, in particular sidelobes within specifications, even as a result of flipping 90 degrees. Referring to FIG. 8, a plot of an antenna pattern 802 of a dual offset Gregorian antenna (DOGA) operating at an inclination of about 90 degrees, a typical mask 800 is shown. In this non-limiting example of an antenna plot, mask 800 represents the Anatel SatCom specification (refer back to FIG. 4 for examples of typical specifications). This antenna pattern 802 fully complies with the SatCom regulations represented by typical mask 800, as can also be seen from test results 804 where the percentage of sidelobes exceeding the mask (Reg %) of 5.5 is less than the Anatel specification of a maximum of 10%. Referring to FIG. 9, a plot of an antenna pattern 902, from a DOGA operating according to an implementation of the current embodiment at about 45 degrees, a typical mask 800 is shown. Operation at about 45 degrees results in good performance and compliance with the SatCom regulations (Reg %=7.4 shown as 904, which is within the specification of 10%, as described above). Referring to FIG. 10, a plot of an antenna pattern 1002 of a DOGA operating at an inclination of about 0 (zero) degrees, a typical mask 800 is shown. This plot 1002 shows that operation of a DOGA at about a 0 degree inclination results in a lower performance level, and in particular has the highest level of sidelobes, and is non-compliant with communications regulations (Reg %=20.5 shown as 1004, which exceeds the specification limit of 10%, as described above) and/or uses increased bandwidth, as compared to compliant operation.

Figure 11:
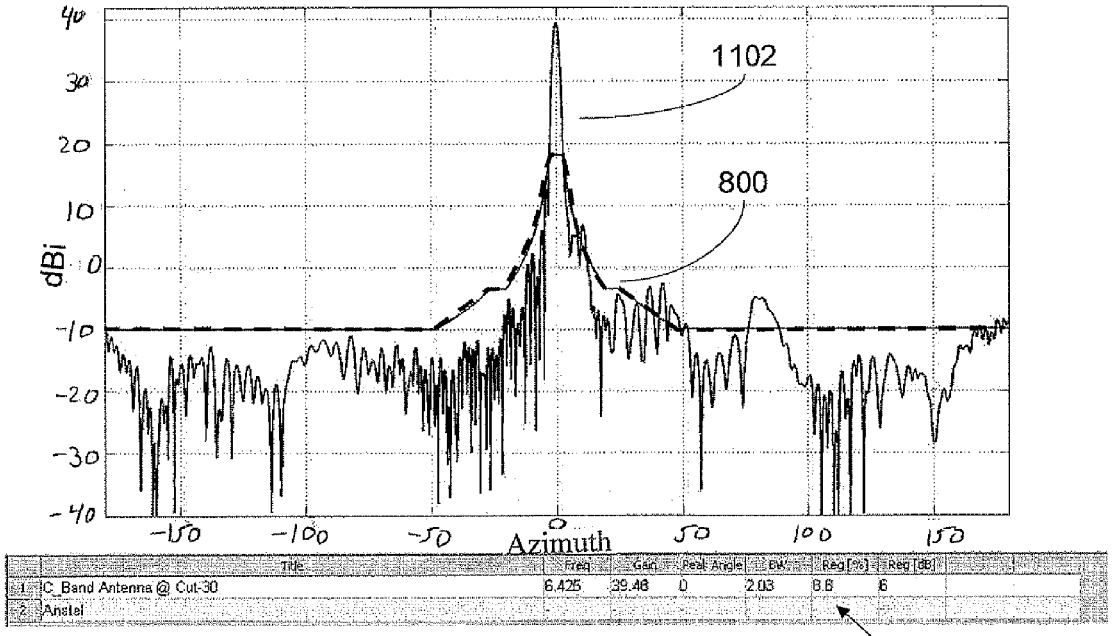
FIG. 11, a plot of an antenna pattern of a DOGA operating at an inclination of about 60 degrees.
Figure 12:
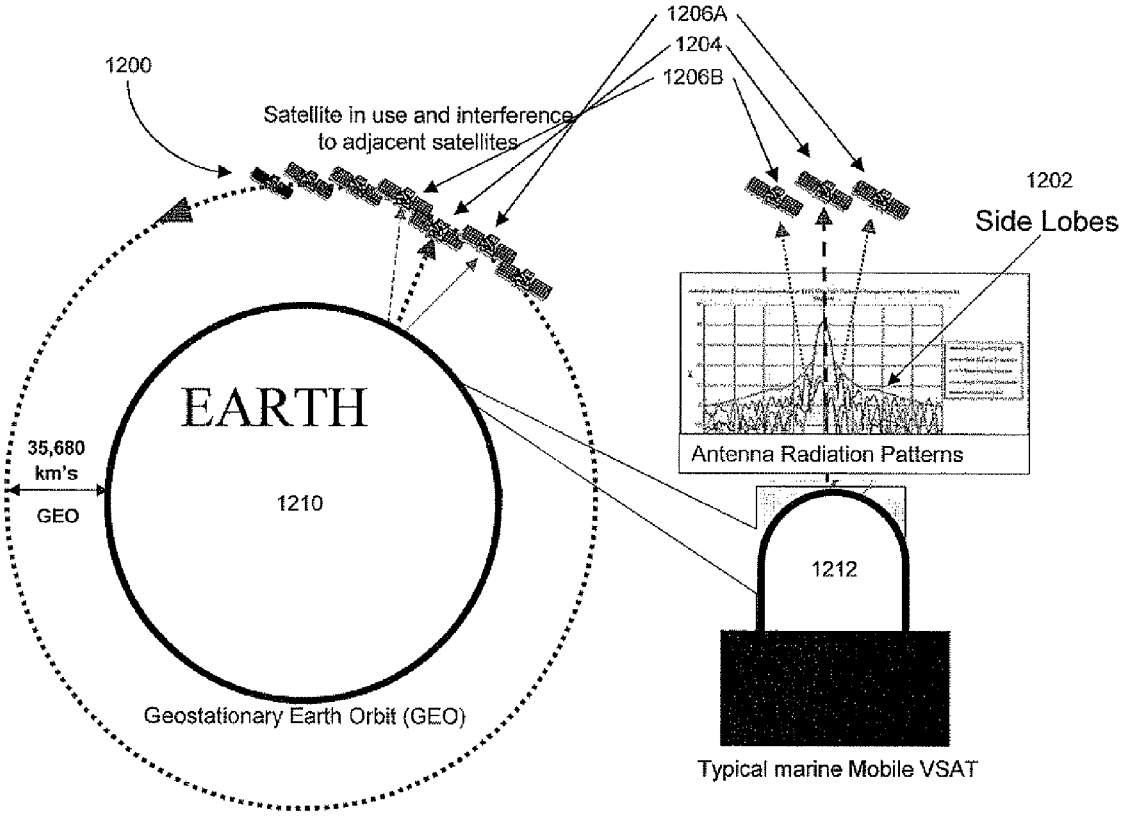
PRIOR ART FIGURE 12
FIG. 12, a diagram of geostationary satellites showing transmission interference.

Referring to FIG. 11, a plot of an antenna pattern 1102 of a DOGA operating at an inclination of about 60 degrees, a typical mask 800 is shown. This plot 1102 shows that operation at an inclination up to about 60 degrees still results in good performance and compliance with specifications (Reg %=8.8 shown as 1104, which is within the specification of 10%, as described above). Note that operating at an inclination between 45 and 60 degrees is equivalent to operating at an inclination between 45 and 30 degrees. A non-limiting example of pre-determined antenna inclination range for operation of a DOGA according to an implementation of the current embodiment is operating between 30 and 60 degrees. Implementations of the current embodiment that operate substantially within a pre-determined antenna inclination range of a 45 degree angle relative to a configuration of the DOGA and a position of the target (inclination) typically result in sufficient performance.

Figure 2:
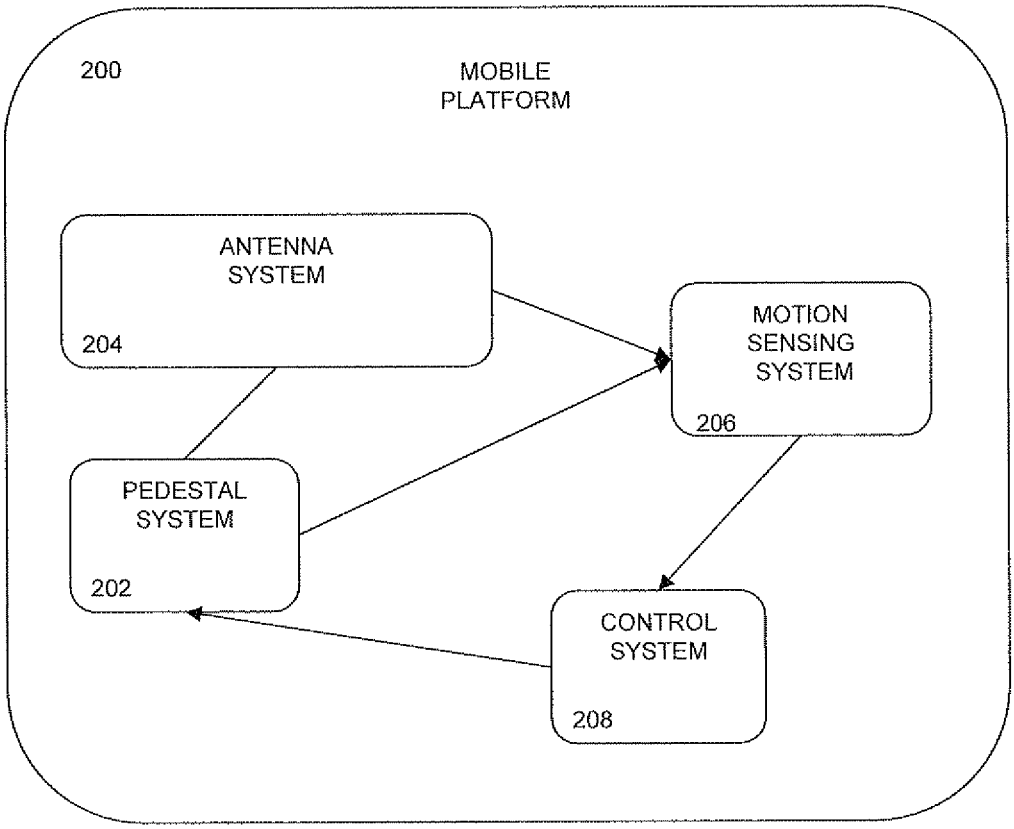
FIG. 2, a diagram of a system for transmitting a signal from a mobile platform to a target.

Referring to FIG. 2, a diagram of a system for transmitting a signal from a mobile platform to a target with a reduced sized antenna system while meeting the required satellite communications regulations, a preferred implementation of the system is on a mobile platform 200. A pedestal system 202 is mounted to mobile platform 200 and operational to control the orientation of an antenna system 204. The antenna system 204 includes an antenna, which is a dual offset noncircular antenna, preferably a dual offset Gregorian antenna (DOGA). A motion sensing system 204 is operational to provide motion information, where motion information includes orientation of the antenna relative to the mobile platform 200. A control system is operationally connected to the motion sensing system 204 and configured to use the motion information to control the pedestal system 202 to maintain an inclination the antenna substantially within a pre-determined antenna inclination range of a 45 degree angle relative to a configuration of the antenna and a position of a target.

In a preferred implementation, the mobile platform 200 is a ship and the target is a geostationary satellite. Depending on the application, the target can be a variety of receivers and/or transmitters including, but not limited to, non-geostationary satellites. This embodiment can also be used in cases where the platform and/or the target are not mobile.

Pedestal systems are known in the art, and a 4-axis pedestal system can be used to control azimuth, elevation, tilt, and polarization of the antenna. In one implementation, polarization control can be used with a 3-axis pedestal system, such as taught in U.S. Pat. No. 5,419,521 Three-axis pedestal to Robert J. Matthews (Matthews). Matthews teaches a three axis pedestal system where each axis intersects at a substantially common point. Another implementation can use a pedestal system where one or more axes lack a common point of intersection.

Depending on the application, a variety of motion sensing systems can be used. An implementation that has been shown to be particularly successful is where the motion sensing system 206 includes an inertial measurement unit (IMU). Preferably, the IMU is mounted to the mobile platform 200 as shown in FIG. 1 as component 102. The motion sensing system can also include axis sensors on the pedestal system.

Referring again to FIG. 7, in one implementation, the 45 degree angle (710A, 710B) is relative to a reference line 708 from a feed 706 mounted on a surface of a DOGA to an edge of the DOGA of the surface and opposite the feed. In another implementation, the inclination of the DOGA is maintained such that sidelobes of a radio frequency (RF) signal transmitted from the DOGA are suppressed below a pre-determined level. In another implementation, the inclination of the DOGA is maintained at an oblique angle relative to a position of a target, the inclination sufficient to suppress below a pre-determined level sidelobes of a radio frequency (RF) signal transmitted from the DOGA. In this context, oblique refers to an angle that is neither perpendicular nor parallel to the feed, such as the 45 degree angles represented by lines 710A and 710B, or an angle within a pre-determined antenna inclination range of lines 710A or 710B.

A key feature of the current embodiment is facilitating deployment of at least an antenna system 204 and associated pedestal system 202 inside a reduced size radome, as compared to conventional implementations. Refer again to FIG. 1 that includes a dual-offset Gregorian antenna 100 in a radome 104, with optional IMU 102. As described above the system facilitates implementation of an antenna system having a radome to antenna ratio of 1.23. Generally, the radome to antenna ratio is calculated using an outside diameter of the radome compared to an outside diameter of the contained antenna, which in the current description is a long axis of a DOGA. The current embodiment is particularly successful in facilitating a reduced radome to antenna ratio when operating at frequencies including: C-band (Rx: 3.4-4.2 GHz, Tx: 5.8-6.7 GHz), Ku-band (Rx: 10.7-12.7 GHz, Tx: 13.7-14.5 GHz), X-band (Rx: 7.2-7.7 GHz, Tx: 7.9-8.4 GHz), and Ka-band (Rx: 17.7-21.2 GHz, Tx: 27.5-31 GHz).

The current embodiment facilitates full atmospheric coverage and elevation to −20 degrees. A negative elevation can be necessary in some situations, for example, when a ship is at a high latitude and the antenna system needs to compensate for the ship's motion to point the antenna at the equator to establish VSAT (very small aperture terminal) communications with a geostationary satellite. The current embodiment is particularly useful for VSAT, ESV (Barth station vessel), and similar communications.

Figure 3:
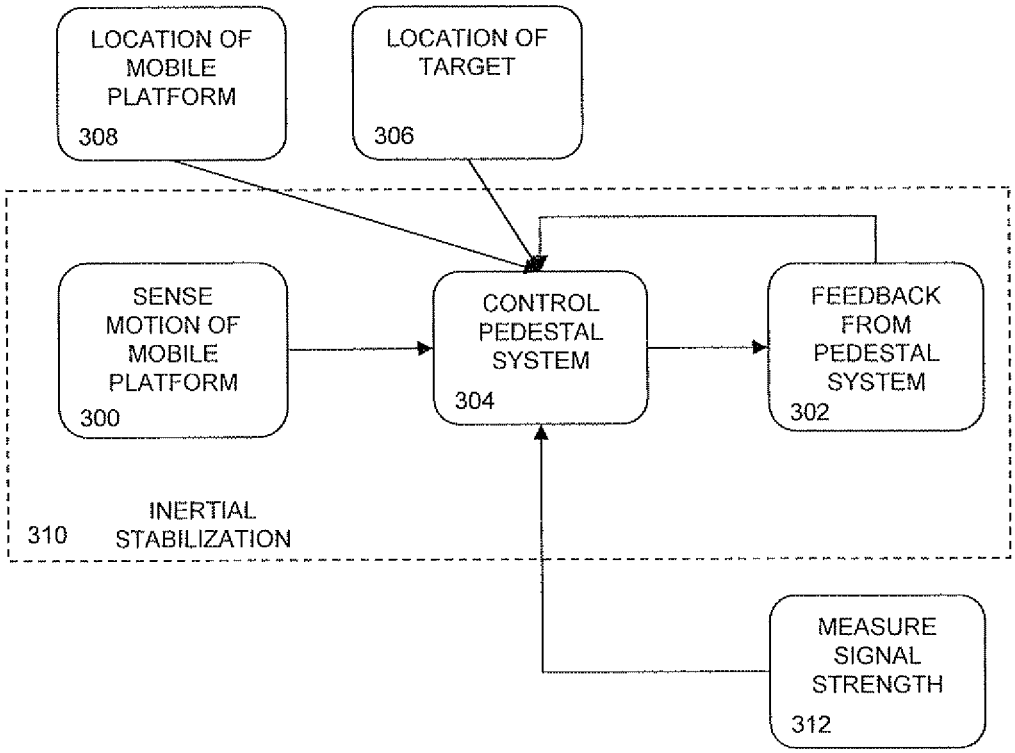
FIG. 3, a diagram of a method for transmitting a signal from a mobile platform to a target.

Referring to FIG. 3, a diagram of a method for transmitting a signal from a mobile platform to a target with a reduced sized antenna system while meeting the required satellite communications regulations, the method includes sensing 300 motion of the mobile platform. Typically, an antenna is mounted to a pedestal system, and feedback 302 from the pedestal system provides information on the orientation of an antenna. The specific structure and content of feedback depend on the application. A popular implementation of feedback is to use encoders on the axes of the pedestal to supply axes' position and/or movement information. Preferably, the antenna is a dual offset noncircular antenna, most preferably a dual offset Gregorian antenna system (DOGA). In an alternative implementation, the antenna is a dual offset Cassegrain antenna. Sensing 300 motion of the mobile platform in combination with feedback 302 from the pedestal system provides motion information on orientation of the antenna relative to the mobile platform. Predicated position of the target and/or ephemeris data, including the location of the target 306, can be provided to control 304 the pedestal system. Control 304 of the pedestal system is based on the provided motion information and predicted position of a target. Typically, control is via generated control information. All information is converted to pedestal axes control information. Control information includes, but is not limited to, control of four axes of a pedestal, including polarization. As described above, polarization is typically controlled inside the feed, so typically separate control information is used to control the three axes of the pedestal and polarization. The generated control information is sufficient to control an orientation of the antenna such that an inclination of the antenna is maintained substantially within a pre-determined antenna inclination range of a 45 degree angle relative to a configuration of the antenna and a position of the target.

In a preferred implementation, an orientation of a dual offset noncircular antenna system is measured relative to a mobile platform on which the antenna is mounted. The antenna is aimed at a target while, responsive to the measuring of the orientation, an inclination of the antenna is maintained substantially within a pre-determined antenna inclination range of a 45 degree angle relative to a configuration of the antenna and a position of the target.

The location of the target 306 is provided for control 304 of the pedestal system. Depending on the application, the location of the target 306 can be provided by a variety of means, including but not limited to, for geostationary satellites providing a longitude, and for all targets providing a frequency to track. Based on this description, one skilled in the art will be able to select an appropriate implementation for the application.

The location of the mobile platform 308 is also provided for control 304 of the pedestal system. Depending on the application, the location of the mobile platform 308 can be provided by a variety of means, including but not limited to, latitude and longitude from a global positioning system (GPS). Based on this description, one skilled in the art will be able to select an appropriate implementation for the application.

In a preferred implementation, the mobile platform is a ship and the target is a geostationary satellite.

In one implementation, the control 304 of the pedestal system is via control information that controls the orientation of a dual offset noncircular antenna via a 4-axis pedestal system operational to control azimuth, elevation, tilt, and polarization.

Motion information can be provided by a variety of sources and from one or more locations on the mobile platform, pedestal system, and/or antenna system. In a preferred implementation, motion information is provided by a motion sensing system that includes an inertial measurement unit (IMU). The IMU can be mounted to the mobile platform. In another implementation, the motion information is provided by a motion sensing system that includes axes sensors on a pedestal system.

In one implementation, the 45 degree angle is relative to a reference line from a feed mounted on a surface of the dual offset noncircular antenna to an edge of the antenna of the surface and opposite the feed. An implementation of this reference line is described above in reference to FIG. 7, object 708.

Maintaining the inclination of the antenna can be understood and implemented in a variety of ways, depending on the application. In one implementation, the inclination of the antenna is maintained such that sidelobes of a radio frequency (RF) signal transmitted from the antenna are suppressed below a pre-determined level. In another implementation, the inclination of the antenna is maintained at an oblique angle relative to a feed of the antenna (refer to FIG. 7, object 708) sufficient to suppress below a pre-determined level sidelobes of a radio frequency (RF) signal transmitted from the antenna.

Using motion information to control an orientation of the antenna is generally referred to as inertial stabilization. In FIG. 3, the blocks included in inertial stabilization are grouped as block 310. In addition to inertial stabilization, that can provide the majority and/or large adjustments in antenna orientation, measuring 312 the signal strength can be used to improve control 304 of the pedestal system, also referred to as signal correction. Given a frequency to track, a received signal from an antenna, through a receiver, can be processed by a detector to determine the signal strength. Information derived from the signal strength can be fed back for control 304 of the pedestal system. In a case like this, generating control information further includes using a radio frequency (RF) associated with the target, which is the frequency to track.

The following is a non-limiting description of an implementation of a tracking technique using a combination of inertial stabilization (for example with an IMU) and signal correction (one version of which is the commercially available Step-track™ by Orbit Communications Systems, Ltd.). Further information can be found in the paper "Tracking Principals of Orbit Marine Stabilized Antenna Terminals", by Azriel Yakubovitch, May 2009

The larger part of tracking dynamics is covered by inertial stabilization. Signal correction is used to close the residue of the tracking inaccuracies resulting in slowly developing drift of the inertial stabilization, for example drift of an inertial measurement unit (IMU), static mechanical deviations between IMU and the pedestal axes, as well static installation inaccuracy with respect to a Compass sensor, or Satellite inclination.

The static mechanical inaccuracies of an antenna pedestal are recorded for every production unit during the antenna pedestal's final integration and checkout. As some of the sources of inaccuracies may originate outside of the antenna system (for example—satellite inclination, and compass drift), the utilization of Step-track™ makes the tracking robust and invariant to the mentioned inaccuracies.

The mobile platform's deviation from Earth referenced level is measured by the IMU. The IMU also reports the current ship's yaw, using the external compass as a long-term reference, processing the yaw together with the compass's own sensors to produce an accurate yaw reading even in high dynamics. An IMU design is used that is insensitive to linear acceleration perturbations, having a reliable smooth readout even in vibrating and high dynamics conditions. The user selected satellite view angles are calculated using information of the ship's current longitude and latitude read from an internal GPS sensor. Position and velocity drive commands are calculated for each of pedestal axes. The position and velocity axes-commands are fed into a digital control loop (DCL) processor of every axis. The DCL of every axis produce an analog command to the axes drive-chain that includes motor-driver, motor, and a reduction gear. Note that the drive-chain is implemented sufficiently robust and powerful to provide enough torque even if the antenna axes are not accurately balanced.

Once the antenna is oriented towards the satellite nominal position, the Step-track™ algorithm is applied. The Step-track moves the antenna in a small conical scan (0.1-0.2 degrees) around the Antenna bore-site. A two dimensional signal correction error is calculated. Note that although the conical scan is completed every 1.5-2 seconds, the error is recalculated in much higher rate, thus creating a continuum of the error information. The conical scan error is mathematically added to the antenna view angles, so that the antenna will look at all times to the point of maximal reception energy.

The maximal reception is accurately measured by the assignee's proprietary narrow-band receiver (NBR), developed especially for the assignee's marine terminals, available from Orbit Communications Systems, Ltd., Netanya, Israel. The NBR allows the system to lock on signals as narrow as the satellite clean-carrier beacon and as wide as a signal from a digital TV transponder. The unique quality of the NBR is that the NBR was constructed for the sole purpose of accurately measuring the signal strength in high resolution (0.1 dB), wide dynamic range (50 dB) and without any delay (hard-real-time).

The antenna system of the current embodiment can be preferably be implemented as a modular antenna system which allows rapid/easy change of frequency band (using kits such as C-Band, X-Band, and Ku-Band RF Packages).

Note that a variety of implementations for modules and processing are possible, depending on the application. Modules are preferably implemented in software, but can also be implemented in hardware and firmware, on a single processor or distributed processors, at one or more locations. Module functions can be combined and implemented as fewer modules or separated into sub-functions and implemented as a larger number of modules. Based on the above description, one skilled in the art will be able to design an implementation for a specific application.

It should be noted that the above-described examples, and numbers used, are to assist in the description of this embodiment. Inadvertent typographical and mathematical errors should not detract from the utility and basic advantages of the invention.

The above description has focused on a preferred implementation including a mobile platform, a geostationary satellite, and a dual offset noncircular antenna. It will be obvious to one skilled in the art that the present embodiment can also be implemented for a stationary platform and/or a stationary or moving target, including other types of satellites and other receivers and transmitters.

It will be appreciated that the above descriptions are intended only to serve as examples, and that many other embodiments are possible within the scope of the present invention as defined in the appended claims.

What is claimed is:

1. A system for aiming comprising:

(a) an offset feed mounted on a first edge of, and within the circumference of, a non-circular antenna, corresponding to a dual offset noncircular antenna (DONCA), wherein said non-circular antenna has a first axis from said offset feed to a second edge opposite said first edge of said non-circular antenna;

(b) a pedestal system mounted to a mobile platform and operational to control orientation of the DONCA mounted on said pedestal system;

(c) a motion sensing system operational to provide motion information on said orientation of the DONCA relative to the mobile platform; and (d) a control system operationally connected to said motion sensing system and configured to use said motion information to control said pedestal system to maintain an inclination of the DONCA substantially within a predetermined antenna inclination range, said pre-determined antenna inclination range centered around an antenna inclination of 45 degrees relative to said first axis and a position of a target.

2. The system of claim 1 wherein the dual offset noncircular antenna (DONCA) is a dual offset Gregorian antenna system (DOGA).

3. The system of claim 1 wherein the dual offset noncircular antenna (DONCA) is a dual offset Cassegrain antenna system.

4. The system of claim 1 wherein the mobile platform is a ship.

5. The system of claim 1 wherein said pedestal system is a 4-axis pedestal system operational to control the DONCA.

6. The system of claim 1 wherein the target is a geostationary satellite.

7. The system of claim 1 wherein said motion sensing system includes an inertial measurement unit (IMU).

8. The system of claim 7 wherein said IMU is mounted to the mobile platform.

9. The system of claim 1 wherein said pedestal system includes axes and said motion sensing system includes axes sensors on said axes.

10. The system of claim 1 wherein said pre-determined antenna inclination range includes angles substantially between 30 and 60 degrees.

11. The system of claim 1 wherein said control system is configured to maintain said inclination of the DONCA such that sidelobes of a radio frequency (RF) signal transmitted from the DONCA are suppressed below a pre-determined level.

12. The system of claim 1 wherein said control system is configured to maintain said inclination of the DONCA at an oblique angle relative to the position of the target, said inclination sufficient to suppress below a pre-determined level sidelobes of a radio frequency (RF) signal transmitted from the DONCA.

13. The system of claim 1 further including a radome, the DONCA and said pedestal system being mounted inside said radome.

14. The system of claim 13 wherein the DONCA has a long axis corresponding to the long diameter of the non-circular antenna and a ratio of an outside diameter of said radome to the long axis of said DONCA is less than 1.24.

15. The system of claim 1 wherein said DONCA operates at frequencies selected from the group consisting of:

(a) C-band frequencies including receiving at 3.4-4.2 GHz and transmitting at 5.8-6.7 GHz;

(b) at Ku-band frequencies including receiving at 10.7-12.7 GHz and transmitting at 13.7-14.5 GHz;

(c) X-band frequencies including receiving at 7.2-7.7 GHz and transmitting at 7.9-8.4 GHz; and (d) Ka-band frequencies including receiving at 17.7-21.2 GHz and transmitting at 27.5-31 GHz.

16. A method comprising the steps of:

(a) measuring an orientation of a dual offset noncircular antenna (DONCA) relative to a mobile platform whereon said DONCA is mounted, wherein said DONCA includes an offset feed mounted on a first edge of, and within the circumference of, a non-circular antenna, and wherein said non-circular antenna has a first axis from said offset feed to a second edge opposite said first edge of said non-circular antenna;

(b) aiming said DONCA at a target while, responsive to said measuring of said orientation, maintaining an inclination of said DONCA substantially within a pre-determined antenna inclination range, said pre-determined antenna inclination range centered around an antenna inclination of 45 degrees relative to a said first axis and a position of a target.

17. The method of claim 16 wherein said DONCA is a dual offset Gregorian antenna (DOGA).

18. The method of claim 16 wherein said DONCA is a dual offset Cassegrain antenna.

19. The method of claim 16 wherein said mobile platform is a ship.

20. The method of claim 16 wherein said aiming of said DONCA is via a 4-axis pedestal system.

21. The method of claim 16 wherein said target is a geostationary satellite.

22. The method of claim 16 wherein said measuring of said orientation includes measuring via a motion sensing system that includes an inertial measurement unit (IMU).

23. The method of claim 22 wherein said IMU is mounted to said mobile platform.

24. The method of claim 16 wherein said measuring of said orientation includes measuring via axes sensors on axes on a pedestal system, wherein said pedestal system is used to aim said DOGA.

25. The system of claim 16 wherein said pre-determined antenna inclination range includes angles substantially between 30 and 60 degrees.

26. The method of claim 16 wherein said aiming maintains said inclination of said DONCA such that sidelobes of a radio frequency (RF) signal transmitted from said DONCA are suppressed below a pre-determined level.

27. The method of claim 16 wherein said aiming maintains said inclination of said DONCA at an oblique angle relative to the position of the target, said inclination sufficient to suppress below a pre-determined level sidelobes of a radio frequency (RF) signal transmitted from said DONCA.

28. The method of claim 16 wherein a plurality of radio frequencies (RFs) is associated with said target and said aiming is based on one of said plurality of RFs.

29. The method of claim 16 wherein said aiming is based on information derived from a signal strength of a radio frequency (RF) associated with said target.

* * * * *